United States Patent [19]

Cadars

[11] Patent Number: 4,625,793

[45] Date of Patent: Dec. 2, 1986

[54] HEADER FOR A HEAT EXCHANGER

[75] Inventor: Patrick Cadars, Montigny le Bretonneux, France

[73] Assignee: Valeo - Societe Anonyme Francais, Paris, France

[21] Appl. No.: 775,673

[22] Filed: Sep. 13, 1985

[30] Foreign Application Priority Data

Sep. 14, 1984 [FR] France ..... 84 14154

[51] Int. Cl.[4] ..... F28D 1/04

[52] U.S. Cl. ..... 165/151; 165/173

[58] Field of Search ..... 165/151, 173

[56] References Cited

U.S. PATENT DOCUMENTS

| | | | |
|---|---|---|---|
| 4,226,280 | 10/1980 | deCenival | 165/173 X |
| 4,381,033 | 4/1983 | Woodhull, Jr. | 165/175 |
| 4,485,867 | 12/1984 | Melnyk et al. | 165/173 |

FOREIGN PATENT DOCUMENTS

| | | | |
|---|---|---|---|
| 0022235 | 1/1981 | European Pat. Off. | 165/173 |
| 0022234 | 1/1981 | European Pat. Off. | 165/173 |
| 0113003 | 11/1983 | European Pat. Off. . | |
| 3341361 | 8/1984 | Fed. Rep. of Germany | 165/173 |
| 2369076 | 5/1978 | France . | |
| 2484071 | 12/1981 | France | 165/173 |
| 2527706 | 2/1983 | France . | |
| 29777 | of 1912 | United Kingdom . | |
| 1596406 | 8/1981 | United Kingdom . | |

*Primary Examiner*—Albert W. Davis, Jr.
*Assistant Examiner*—Randolph A. Smith
*Attorney, Agent, or Firm*—Dennison, Meserole, Pollack & Scheiner

[57] ABSTRACT

A header of plastic material for a heat exchanger of the tube type has two identical faces provided with projecting ribs. The internal partition-wall of a water box is fitted between the ribs of one header face while the ribs of the other face are applied against an end fin of the tube bank.

4 Claims, 3 Drawing Figures

HEADER FOR A HEAT EXCHANGER

BACKGROUND OF THE INVENTION

1. Field of the Invention

This invention relates to a header for a tube-bank heat exchanger as well as to a heat exchanger which is equipped with said header and is primarily intended for use in the automobile industry.

2. Description of the Prior Art

In accordance with known practice, a header or tube sheet of a heat exchanger of this type can consist of a flat plate of rectangular shape provided with holes in which the tube ends are mounted in fluid-tight manner. These holes can be defined by tubular cylindrical collars which project from the plate in order to improve the leak-tightness of assembly of the tube ends.

The header can be formed of plastic material in known manner, with the result that the fluid-tight tube ends can be mounted directly in the holes or collars of the header without interposition of seals.

The water box which is mounted on the header in a conventional manner is usually formed of plastic material and secured to the header by seal-welding. In many designs, the water box has an internal partition-wall which extends at right angles to the header and the free edge of which has to be tightly applied against the header in order to divide the internal space of the water box into two chambers which are separated from each other in a substantially fluid-tight manner.

When the heat exchanger is in service, a fluid circulates within said heat exchanger and in particular within the aforementioned water box, with the result that both faces of the internal partition-wall of said water box are continuously in contact with the fluid. In the course of time, this finally gives rise to deformations of said internal partition-wall, the free edge of which becomes detached from the header face on which it had been applied or fixed in a substantially fluid-tight manner. In consequence, the partition-wall between the two chambers of the water box no longer provides a fluid-tight separation.

SUMMARY OF THE INVENTION

The present invention is primarily intended to overcome this disadvantage and accordingly proposes a header for a tube-bank heat exchanger, said header being constituted by a plate of plastic material provided with holes for mounting the tube ends. The distinctive feature of the header lies in the fact that two parallel ribs are formed on the header face located externally with respect to the tube bank and that a groove is defined between said ribs and extends between said mounting holes.

The above-mentioned groove is intended to receive the free edge of the internal partition-wall of the water box which is fixed on the header. Thus even if deformation of the internal partition-wall finally develops, the free edge of said partition-wall is permanently maintained within the groove located between the two parallel ribs of the header, thereby guaranteeing a substantially fluid-tight separation between the two chambers of the water box.

According to another distinctive feature of the invention, the opposite face of the header is also provided with two ribs which are parallel and identical with the ribs of the other header face.

The header can thus have a symmetrical structure since its two faces are identical with each other, thus removing any risk of error at the time of assembly of the heat exchanger.

According to another distinctive feature of the invention, when the holes are defined by tubular collars which project from the header plate, said ribs have substantially the same height as said collars on each face of the header and extend along this latter in the longitudinal direction. The longitudinal orientation of the ribs can be defined as perpendicular to the flow of air through the tube bank when the heat exchanger is in service.

When the heat exchanger is assembled, the ribs which are formed on the header face remote from the water box and which have the same height as the collars can come into contact with the end fin of the tube bank and can prevent any flow of air between the header and said end fin in a transverse direction, that is to say at right angles to the direction of said ribs.

The invention further relates to a tube-bank heat exchanger comprising a header of the aforementioned type and a water box fixed on the header, said water box being formed with an internal partition-wall which is perpendicular to the header and one edge of which is received in the groove formed by the aforementioned ribs of the header.

Said edge of the internal partition-wall of the water box is advantageously fixed in a fluid-tight manner, for example by seal-welding within the groove of the header.

BRIEF DESCRIPTION OF THE DRAWINGS

Other features of the invention will be more apparent to those versed in the art upon consideration of the following description and accompanying drawings, wherein.

DETAILED DESCRIPTION OF THE INVENTION

Figure 1:
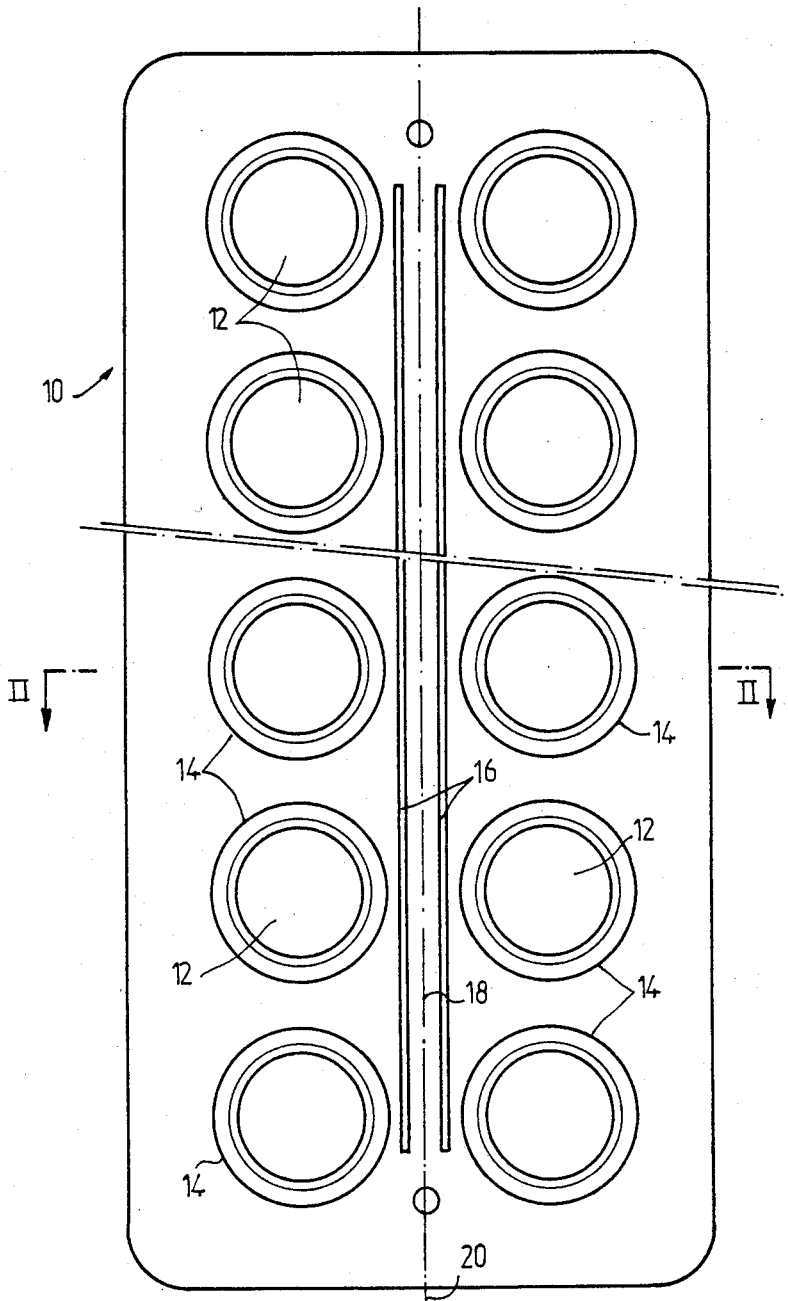
FIG. 1 is a plan view of a header in accordance with the invention.
Figure 2:
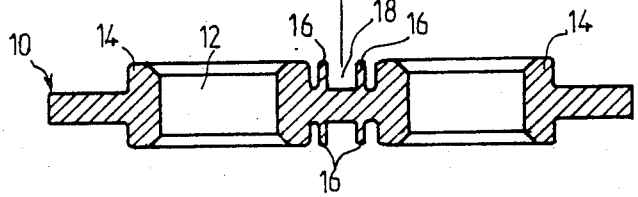
FIG. 2 is a sectional view taken along line II—II of FIG. 1.

The header 10 or tube sheet which is illustrated in FIGS. 1 and 2 consists of a flat plate of molded plastic having a rectangular contour in which are formed cylindrical holes 12 arranged in rows and in columns parallel to the edges of the plate 10 and defined by tubular cylindrical collars 14 which project on each side of the plate and thus have a height exceeding the thickness of the plate.

As illustrated in FIGS. 1 and 2, the ends of the collars 14 can be internally chamfered, with the result that the ends of the holes 12 are slightly flared-out.

Each large face of the header comprises two projecting parallel ribs 16. A groove 18 is defined between said ribs and extends lengthwise along the header, for example along the longitudinal median axis 20 of this latter. The ribs 16 terminate in the vicinity of the ends of the header and therefore extend over the greater part of the length of this latter. Preferably, the height of the ribs 16 which form projections from the header plate 10 is substantially equal to the height of the collars 14.

In the example of construction illustrated in the drawings, the ribs 16 formed on one face of the header 10 are strictly identical with those formed on the other face and are symmetrical with these latter, with the result that the two header faces are strictly identical with each other. However, these ribs 16 could be relatively displaced from one header face to the other.

Figure 3:
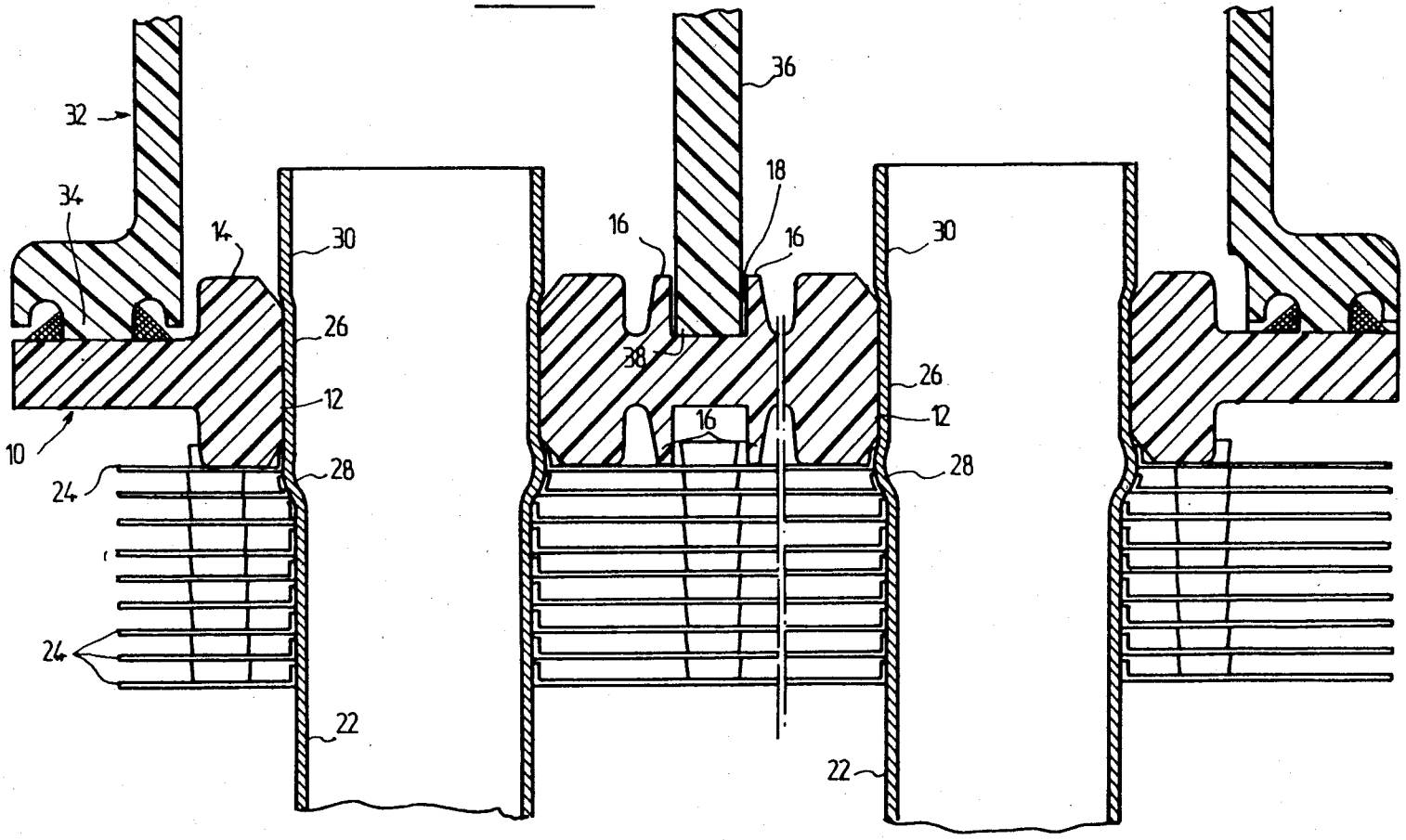
FIG. 3 is a fragmentary sectional view of a heat exchanger comprising a header in accordance with the invention.

Said header is intended to be employed in a heat exchanger which is partly illustrated in FIG. 3 and comprises a bank of parallel tubes 22 fitted with flat and parallel fins 24 through which the tubes 22 pass at right angles, the fins being secured to the tubes by crimping, for example.

The ends of the tubes 22 are mounted in fluid-tight manner within the holes 12 of the header by utilizing, for example, the elasticity of the plastic material forming the header. This known technique consists in inserting the ends of the tubes 22 in the holes of the headers, then in subjecting the tube ends to radial expansion by plastic deformation but without exceeding the elastic limit of the header material, then in reducing the radial tube-end expansion forces to zero. Under the action of their elasticity, the collars 14 which define the holes of the header are restored to their initial shape by producing radial shrinkage of the tube portions 26 located between two tube portions 28 and 30 which are not in contact with the header and which remain radially expanded. This has the simultaneous effect of achieving fluid-tightness between the tube ends and the header as well as locking the tubes within the holes of the header.

When the tube ends are thus mounted in fluid-tight manner in the holes of the header, the end fin 24 of the tube bank is applied against the entire length of the ribs 16 formed on that face of the header 10 which is directed towards said fins. The end fin 24 is also applied at intervals against the ends of the collars 14 as shown in FIG. 3 when the ribs 16 and the collars 14 have the same height of projection from the header 10.

A water box 32 of a conventional type (only part of which is illustrated in FIG. 3) is then mounted on the header 10 and secured to this latter by a method such as ultrasonic welding, for example. To this end, the water box 32 has a peripheral flange 34 which is welded on the corresponding face of the header 10 in the vicinity of the periphery of this latter.

The water box 32 is formed by molding with an internal partition-wall 36, the free edge 38 of which is received and welded within the groove 18 which is delimited by the ribs 16 of the corresponding face of the header 10.

While the heat exchanger is in service, the edge 38 of the internal partition-wall 36 of the water box thus remains engaged between the ribs 16 of the header and guarantees a fluid-tight separation between the two chambers which are delimited within the water box by said internal partition-wall 36. The deformations of said partition-wall 36, the two faces of which are continuously in contact with the fluid circulated within the heat exchanger, exert a stress at the level of the welded joint between the edge 38 of said partition-wall and the header but are not of sufficient magnitude to cause said edge 38 to escape completely from the groove which is limited by the ribs 16.

As mentioned earlier, the ribs 16 formed on the other face of the header and applied against the end fin 24 of the tube bank form a barrier which prevents any circulation of air between the header 10 and the end fin 24 of the tube bank in a direction at right angles to that of the ribs 16.

When the two large faces of the header 10 are identical, said header can be mounted in one direction or in the other between the water box 32 and the tube bank, thus guarding against any risk of error at the time of assembly of the heat exchanger.

What is claimed is:

1. A header plate for a tube bank heat exchanger, said header plate including inner and outer faces and means defining a longitudinally and laterally spaced array of mounting holes extending therethrough, each hole dimensioned to sealingly receive one end of one of the tubes in said bank, a pair of parallel ribs formed on each of said inner and outer faces of said header plate in symmetry, groove means defined by and between each rib pair and a tubular collar encircling each mounting hole and projecting outwardly therefrom away from each face of said header plate substantially the same distance as said rib pairs to define each face of the header plate as substantially identical and symmetrical.

2. A header plate according to claim 1 wherein the groove defined by said parallel ribs extends along the longitudinal median axis of said header plate.

3. A tube bank heat exchanger header plate defined by claim 1 wherein said heat exchanger includes a water box mounted on one side of said header plate and said water box includes an internal partition wall configured to extend into said groove on the outer face of said header plate, fin means on the opposite inner side of said header plate including at least one end fin and a plurality of secondary fins in generally parallel array, said symmetrical ribs on said opposite face of said header plate from said water box being positioned to sealingly engage said end fin to prevent air flow between said header plate and said end fin in a direction transverse to the longitudinal axis of said ribs.

4. A heat exchanger header plate according to claim 3 wherein the edge of the internal partition wall of the water box is sealingly fixed within said groove on the outer face of said header plate.

* * * * *